United States Patent [19]

Adams

[11] 3,997,454

[45] Dec. 14, 1976

[54] LUBRICANT CONTAINING POTASSIUM BORATE

[75] Inventor: John Howard Adams, San Rafael, Calif.

[73] Assignee: Chevron Research Company, San Francisco, Calif.

[22] Filed: June 4, 1975

[21] Appl. No.: 583,723

Related U.S. Application Data

[63] Continuation-in-part of Ser. No. 483,274, July 11, 1974, abandoned, and a continuation-in-part of Ser. No. 505,130, Sept. 11, 1974, abandoned.

[52] U.S. Cl. ..... 252/18; 252/25; 252/33; 252/32.7 E; 252/46.6; 252/46.7; 252/51.5 A

[51] Int. Cl.[2] ..... C10M 3/18; C10M 5/14; C10M 7/20; C10M 7/24

[58] Field of Search ..... 252/18, 25, 33, 32.7 E, 252/51.5 A, 46.6, 46.7

[56] References Cited

UNITED STATES PATENTS 3,853,772 12/1974 Adams ..... 252/18

*Primary Examiner*—Delbert E. Gantz
*Assistant Examiner*—I. Vaughn
*Attorney, Agent, or Firm*—G. F. Magdeburger; C. J. Tonkin; L. L. Priest

[57] ABSTRACT

An extreme-pressure lubricating composition is disclosed comprising an oil of lubricating viscosity having dispersed therein 1 to 60 weight percent of hydrated potassium borate microparticles having a boron-to-potassium ratio of about 2.5 to 4.5 and, optionally, from 0.01 to 5.0 weight percent of an antiwear agent selected from: (a) a zinc dihydrocarbyl dithiophosphate having from 4 to 20 carbons in each hydrocarbyl group; (b) a $C_1$ to $C_{20}$ ester, $C_1$ to $C_{20}$ amide, or $C_1$ to $C_{20}$ amine salt of a dihydrocarbyl dithiophosphoric acid having from 4 to 20 carbons in each hydrocarbyl group; or (c) mixtures thereof.

24 Claims, No Drawings

LUBRICANT CONTAINING POTASSIUM BORATE

CROSS-REFERENCE TO RELATED APPLICATIONS

This application is a continuation-in-part of application Ser. No. 483,274, filed July 11, 1974, now abandoned, and application Ser. No. 505,130, filed Sept. 11, 1974 now abandoned, the disclosures of which are hereby incorporated by reference.

BACKGROUND OF THE INVENTION

Field of the Invention

This invention concerns the extreme-pressure (EP) lubricating oils.

High load conditions often occur in the gear sets used in automotive transmission differentials, pneumatic tools, gas compressors, high-pressure hydraulic systems, metal-working and similar devices, as well as in many types of bearings. In order to avoid the undesirable effects which result when using an uncompounded oil under these high load conditions, the lubricants for use in such service contain "EP agents". For the most part, EP agents have been organic or metallo-organic compounds which are oil-soluble or easily incorporated as a stable dispersion in the oil.

Recently Peeler, in U.S. Pat. No. 3,313,727 disclosed an EP lubricant produced by the dispersion in a nonpolar lubricating oil of an inorganic hydrated sodium or potassium borate. To prepare the lubricant, the borate, water, and an emulsifier were introduced into the nonpolar medium. The mixture was then agitated to produce a microemulsion of the aqueous borate solution in the oil and thereafter heated to remove the liquid water. Peeler also disclosed that conventional additives such as rust inhibitors, foam inhibitors, etc., could be present in the finished lubricating composition containing the borate.

The borate-containing oils described by Peeler have, however, a very serious deficiency in service. If water is introduced into the system containing the borate lubricant, the borate crystallizes out the oil and forms hard granules. These granules can cause severe noise in the system and can in some cases damage the gears or bearings themselves. Further, loss of the borate by crystallization substantially decreases the EP function of the lubricant.

Although the borate dispersion prepared by Peeler has excellent extreme-pressure properties, it has been found that it sealed systems dispersions with high water content have an adverse effect on the seals. It is believed that the alkali metal borate dispersions slowly form solid deposits on shafts at or near the seals. The turning motion of the shafts then slowly abrades the seals, thereby allowing loss of lubricant. In addition, the borate dispersions described by Peeler exhibit a compatibility problem with conventional lubricating oil additives such as phenates, sulfurized fats and zinc dithiophosphates.

It is therefore an object of the invention to provide a lubricant having good extreme-pressure properties.

It is an additional object of this invention to provide an extreme-pressure lubricant having improved compatibility with conventional lubricating oil additives.

It is a further additional object of this invention to provide a borate-containing lubricant having improved seal properties and which has improved compatability with other lubricating oil additives.

It is another object of this invention to provide a lubricant having improved anti-wear properties.

It is another object of this invention to provide a borate-containing lubricant having improved water tolerance.

It is a further additional object of this invention to provide a borate-containing lubricant having improved seal and anti-wear properties and which has excellent extreme-pressure properties.

SUMMARY OF THE INVENTION

It has now been found that an improved extreme-pressure lubricant can be obtained by the incorporation of a particulate dispersion of a hydrated potassium borate having a mean particle size of less than 1 micron and a boron-to-potassium ratio of about 2.5 to 4.5. By employing these hydrated potassium borate dispersions, it was found that lubricants containing them exhibited improved seal properties, while still possessing the excellent extreme-pressure characteristics. In addition, it was discovered that many of the potassium borate dispersions exhibited improved compatibility with other additives which are normally incorporated into lubricating oils.

Additional advantages can be realized by incorporating into a lubricating oil a combination of (1) a particulate dispersion of a hydrated potassium borate having a mean particle size of less than 1 micron, having a boron-to-potassium ratio of about 2.5 to 3.5, and (2) an antiwear agent selected from: (a) a zinc dihydrocarbyl dithiophosphate having from 4 to 20 carbons in each hydrocarbyl group; (b) a $C_1$ to $C_{20}$ ester, a $C_1$ to $C_{20}$ amide or $C_1$ to $C_{20}$ amine salt of a dihydrocarbyl dithiophosphoric acid having from 4 to 20 carbons in each hydrocarbyl group; or (c) mixtures thereof. By this particular combination, I have found that unexpectedly superior anti-wear properties can be imparted to the lubricant without substantially adversely affecting the excellent extreme-pressure properties, water tolerance and good seal properties imparted to the oil by the particulate borate dispersion.

DESCRIPTION OF THE INVENTION

The compositions of this invention are stable EP lubricants. They perform well in standard EP tests such as the Timken test. They are useful in numerous applications wherein extreme pressures are encountered and particularly as automotive differential lubricants. They have fluid or semi-fluid consistencies and many are transparent, a property which is highly advantageous where visual appearance is important or where it is desirable to be able to inspect the lubricated gears or bearings while they are in service. In most cases, they are nontoxic and nonirritating to human skin.

In a first embodiment of this invention, there is provided an extreme-pressure lubricant which comprises a major portion of an oil of lubricating viscosity, and a minor amount of a hydrated potassium borate. Preferably the particles are dispersed in the oil with a mixture of dispersants consisting of an alkali or alkaline earth metal sulfonate and a succinimide.

The hydrated potassium borates of this lubricant composition have the empirical formula $$K_2O.yB_2O_3.xH_2O$$

wherein y is a positive number from 2.5 to 4.5, preferably 2.5 to 3.5, and most preferably about 3; and $x$ is a number from 2.0 to 4.8, preferably from 2.8 to 4.4, and more preferably from 3.2 to 4.0. This formula is intended to be empirical and not to define the exact form in which the potassium, borate and water exist in the oil. Individual borate particles dispersed in the oil may have compositions falling outside this formula, but the over-all composition averaged over all particles will be as defined above.

The borate particles are almost entirely less than 1 micron in size and preferably are less than 0.5 micron.

The compositions of this invention will generally have from about 1 to 60 weight percent (including waters of hydration) of the potassium borate. For lubricating compositions, the concentration will vary from 2.5 to 25 weight percent, preferably from 5 to 15 weight percent. However, by reducing the amount of oil, concentrates can be obtained having 25 to 60 weight percent of the hydrated potassium triborate. These concentrates are diluted to the desired borate concentration by addition of oil prior to use.

In a second embodiment, there is provided an extreme-pressure lubricant comprising an oil of lubricating viscosity, from 1 to 60 weight percent of hydrated potassium borate particulate dispersion having a boron-to-potassium ratio of about 2.5 to 4.5 and from 0.1 to 1.0 weight percent of an anti-wear agent selected from zinc dihydrocarbyl dithiophosphate or a $C_1$ to $C_{20}$ ester, $C_1$ to $C_{20}$ amide, or $C_1$ to $C_{20}$ amine salt of a dihydrocarbyl dithiophosphoric acid having from 4 to 20 carbons in each hydrocarbyl group. Preferably the particles are dispersed in the oil with a mixture of dispersants consisting of an alkali or alkaline earth metal sulfonate and a succinimide.

Preparation of the Potassium Borate

The novel potassium borate dispersions of this invention are prepared by dehydrating a water-in-oil emulsion of an aqueous solution of potassium hydroxide and boric acid to provide a boron-to-potassium ratio of 2.5 to 4.5. The method is carried out by introducing into the inert, nonpolar oil medium an aqueous solution of potassium hydroxide and boric acid (potassium borate solution) and preferably an emulsifier, vigorously agitating the mixture to provide an emulsion of the aqueous solution in the oil and then heating at a temperature and for a time which provides the desired degree of dehydration of the microemulsion.

The temperature at which the emulsion is heated will be generally at least 120° C., and more usually at least 140° C. Temperatures of up to 230° C. may be used, although it is preferred that the temperature not exceed 180° C. Lower temperatures may be used at reduced pressures. However, the process is conveniently carried out at atmospheric pressures and at temperatures in the range described.

The time of reaction will depend on the degree of dehydration, the amount of water present and the temperature. Time is not critical, and will be determined for the most part by the variables mentioned. The water initially present will be sufficient to dissolve the alkali metal borate, but should not be in such excess as to make dehydration difficult.

The potassium borate dispersion may be prepared by an alternative method. In this method, a potassium carbonate-overbased oil-soluble alkali or alkaline earth metal sulfonate is reacted with boric acid to form a potassium borate reaction product. The amount of boric acid reacted with the potassium carbonate should be sufficient to prepare a potassium borate having a boron-to-potassium ratio of at least 5. This potassium borate is converted to potassium borate of this invention by contacting the intermediate borate reaction product with a sufficient amount of potassium hydroxide so as to prepare the potassium borate having a boron-to-potassium ratio between 2.5 and 4.5. The water content may be adjusted by adding water or by dehydrating the product in the manner described earlier.

The reaction of the potassium carbonate-overbased metal sulfonate with boric acid and the subsequent reaction with potassium hydroxide may be conducted at a reaction temperature of 20° to 200° C., and preferably from 20 to 150° C. A reaction diluent may be present during the two reaction stages and subsequently removed by conventional stripping steps.

The antiwear agent for use in the second embodiment of this invention, i.e., the dithiophosphate additive, is present at a concentration of 0.01 to 5.0 weight percent, preferably 0.1 to 2.0 weight percent, and more preferably from 0.25 to 0.50 weight percent. The weight ratio of antiwear agent to particulate potassium borate will usually be between about 0.005 and 10, preferably between about 0.05 and 1, and more preferably between 0.05 and 0.1.

The antiwear agent is a zinc or amine salt, ester or amide of a dihydrocarbyl dithiophosphoric acid. It is formed by reacting the dihydrocarbyl dithiophosphoric acid with: (1) a zinc base; (2) a $C_1$ to $C_{20}$ alcohol or olefin; or (3) a $C_1$ to $C_{20}$ amine. The amide is formed by reacting the dithiophosphoric acid with the amine at elevated temperatures and the amine salt is formed when the dithiophosphoric acid is contacted with the amine at lower temperatures. It is recognized that the amide and amine salt may be present simultaneously.

The hydrocarbyl portion of the dithiophosphoric acid will usually have from 4 to 20 carbons, preferably from 5 to 12 carbons, and more preferably from 6 to 8 carbons. As referred to herein, hydrocarbyl is a monovalent organic radical composed essentially of hydrogen and carbon, but minor amounts of inert constituents may be present. The hydrocarbyl may be aliphatic, aromatic or alicyclic, or combinations thereof, e.g., aralkyl, alkyl, aryl, cycloalkyl, alkylcycloalkyl, etc., and may be saturated or ethylenically unsaturated. Exemplary hydrocarbyl groups include methyl, ethyl, propyl, butyl, pentyl, 4-methylpentyl, 2-ethylhexyl, hexyl, octyl, isooctyl, stearyl, phenyl, benzyl, ethylbenzyl, amyl, propenylphenyl, dipropenylphenyl, tetrapropenylphenyl, tolyl, etc. The primary, secondary or tertiary hydrocarbyl groups may be employed, but the primary groups are preferred.

The ester, amide or amine salt portion of the dithiophosphate will generally have from 1 to 20 carbons, preferably from 4 to 10 carbons, and from 0 to 5 nitrogens (when the amide or amine salt is employed that portion preferably has from 1 to 3 nitrogens with a carbon-to-nitrogen atomic ratio preferably ranging from 1 to 10). The ester, amide or amine salt portion of the antiwear agent will contain stable organic moieties such as hydrocarbon or ethoxylated hydrocarbon groups.

Exemplary zinc dihydrocarbyl dithiophosphates include:

Zinc di(n-octyl) dithiophosphate
Zinc butyl isooctyl dithiophosphate
Zinc di(4-methyl-2-pentyl) dithiophosphate
Zinc di(tetrapropenylphenyl) dithiophosphate Zinc di(2-ethyl-1-hexyl) dithiophosphate
Zinc di(isooctyl) dithiophosphate
Zinc di(hexyl) dithiophosphate
Zinc di(phenyl) dithiophosphate
Zinc di(ethylphenyl) dithiophosphate
Zinc di(amyl) dithiophosphate
Zinc butyl phenyl dithiophosphate
Zinc di(octadecyl) dithiophosphate Exemplary dihydrocarbyl dithiophosphate amides include:

Ethyl amide of di(4-methyl-2-pentyl) dithiophosphate

Butyl amide of di(isooctyl) dithiophosphate

Amino ethyl amide of di(tetrapropenylphenyl) dithiophosphate

Diamino diethylene amide of di(tetrapropenylphenyl) dithiophosphate

Diamino diethylene amide of di(2-ethyl-1-hexyl) dithiophosphate.

The aminoethyl amide is prepared by reacting ethylene diamine with the corresponding dihydrocarbyl dithiophosphoric acid. Similarly, the diamino diethylene amide is prepared by reacting diethylene triamine with the corresponding dihydrocarbyl dithiophosphoric acid.

Exemplary dihydrocarbyl dithiophosphate amine salts include:

Butylamine salt of di(2-ethyl-1-hexyl) dithiophosphate

Pentylamine salt of di(isooctyl) dithiophosphate

Diethylene triamine salt of di(tetrapropenylphenyl) dithiophosphate

Ethylene diamine salt of di(4-methyl-2-pentyl) dithiophosphate.

The preferred antiwear agents are prepared from dialkyl dithiophosphoric acids and preferably the alkyl groups have sterically hindered $C_1$ to $C_3$ branches. Exemplary sterically hindered alkyls include 2-ethyl-1-hexyl, 4-methyl-2-pentyl, etc.

THE LUBRICATING OIL

The oil medium in which the borate, or borate and zinc salt, is dispersed can be any fluid of low dielectric constant which is inert under the reaction conditions (particularly nonsaponifiable) and of lubricating viscosity. Fluids of lubricating viscosity generally have viscosities of from 35 to 50,000 Saybolt Universal Seconds (SUS) at 100° F. (38° C.) The fluid medium or oil may be derived from either natural or synthetic sources. Included among the natural hydrocarbonaceous oils are paraffin base, naphthenic base and mixed base oils. Synthetic oils include polymers of various olefins (generally of from 2 to 6 carbon atoms), alkylated aromatic hydrocarbons, etc. Nonhydrocarbon oils include polyalkylene oxides (e.g., polyethylene oxide), aromatic ethers, silicones, etc. The preferred media are the hydrocarbonaceous oils, both natural and synthetic. Preferred among the hydrocarbonaceous oils are those have SAE viscosity numbers of 5W to 20W and 20 to 250, and especially those having SAE viscosity numbers in the range of 75 to 250.

The lubricating oil content of the composition will depend on the concentrations of the other components, for the lubricating oil constitutes the balance of the composition after the concentrations of the alkali metal borate and any desired additives have been specified. Ordinarily, the oil concentration will range from 65 to about 98 weight percent, preferably 80 to about 95 weight percent, in the working composition, and from about 10 to about 65 weight percent in the concentrate.

DISPERSANTS

The compositions of this invention preferably contain an alkali or alkaline earth metal sulfonate dispersant, and more preferably the compositions contain both a metal sulfonate dispersant and a succinimide dispersant. The ratio of sulfonate to succinimide is a factor in achieving the proper water tolerance properties of the borate lubricant. The sulfonate dispersant is an alkali or alkaline earth metal salt of a hydrocarbyl sulfonic acid having from 15 to 200 carbons. Preferably the terms "sulfonate" encompasses the salts of sulfonic acids derived from petroleum products. Such acids are well known in the art. They can be obtained by treating petroleum products with sulfuric acid or sulfur trioxide. The acids thus obtained are known as petroleum sulfonic acids and the salts as petroleum sulfonates. Most of the compounds in the petroleum product which become sulfonated contain an oil-solubilizing hydrocarbon group. Also included within the meaning of sulfonates are the salts of sulfonic acids of synthetic alkylaryl compounds. These acids also are prepared by treating an alkylaryl compound with sulfuric acid or sulfur trioxide. At least one alkyl substituent of the aryl ring is an oil-solubilizing group, as discussed above. The acids thus obtained are known as alkylaryl sulfonic acids and the salts as alkylaryl sulfonates. The sulfonates wherein the alkyl is straight-chain are the well-known linear alkyl sulfonates.

The acids obtained by sulfonation are converted to the metal salts by neutralizing with a basic reacting alkali or alkaline earth metal compound to yield the Group I or Group II metal sulfonates. Generally, the acids are neutralized with an alkali metal base. Alkaline earth metal salts are obtained from the alkali metal salt by metathesis. Alternatively, the sulfonic acid can be neutralized directly with an alkaline earth metal base.

The sulfonates can then be overbased, although for purposes of this invention overbasing is not necessary. Overbased materials and methods of preparing such materials are well known to those skilled in the art. See, for example, LeSuer, U.S. Pat. No. 3,496,105, issued Feb. 17, 1970, particularly Cols. 3 and 4.

The sulfonates are present in the lubricating oil composition in the form of alkali and/or alkaline earth metal salts or mixtures thereof. The alkali metals include lithium, sodium and potassium. The alkaline metals include magnesium, calcium and barium, of which the latter two are preferred.

Particularly preferred, however, because of their wide availability, are salts of the petroleum sulfonic acids, particularly the petroleum sulfonic acids which are obtained by sulfonating various hydrocarbon fractions, such as lubricating oil fractions and extracts rich in aromatics which are obtained by extracting a hydrocarbon oil with a selective solvent, which extracts may, if desired, be alkylated before sulfonation by reacting them with olefins or alkyl chlorides by means of an alkylation catalyst; organic polysulfonic acids such as benzene disulfonic acid, which may or may not be alkylated; and the like. The preferred salts for use in the present invention are those of alkylated aromatic sulfonic acids in which the alkyl radical(s) contains at least about 8 carbon atoms, for example from about 8 to about 22 carbon atoms. Exemplary members of this preferred group of sulfonate starting materials are the aliphatic-substituted cyclic sulfonic acids in which the aliphatic substituent(s) contains a total of at least 12 carbon atoms, such as the alkylaryl sulfonic acids, alkyl cycloaliphatic sulfonic acids and alkyl heterocyclic sulfonic acids, and aliphatic sulfonic acids in which the aliphatic radical(s) contains a total of at least 12 carbon atoms. Specific examples of these oil-soluble sulfonic acids include: petroleum sulfonic acids, petrolatum sulfonic acids, mono- and polywax-substituted naphthalene sulfonic acids, substituted sulfonic acids, such as cetylbenzene sulfonic acids, cetylphenol sulfonic acids, and the like, aliphatic sulfonic acids, such as paraffin wax sulfonic acids, unsaturated paraffin wax sulfonic acids, hydroxy-substituted paraffin wax sulfonic acids, etc; cycloaliphatic sulfonic acids, such as petroleum napthalene sulfonic acids, cetyl-cyclopentyl sulfonic acids, mono- and polywax-substituted cyclohexyl sulfonic acids, and the like. The term "petroleum sulfonic acids" is intended to cover all sulfonic acids which are derived directly from petroleum products.

Typical Group II metal sulfonates suitable in this composition include the metal sulfonates exemplified as follows: calcium white oil benzene sulfonate, barium white oil benzene sulfonate, magnesium white oil benzene sulfonate, calcium dipolypropene benzene sulfonate, barium dipolypropene benzene sulfonate, magnesium dipolypropene benzene sulfonate, calcium mahogany petroleum sulfonate, barium mahogany petroleum sulfonate, magnesium mahogany petroleum sulfonate, calcium triacontyl sulfonate, magnesium triacontyl sulfonate, calcium lauryl sulfonate, barium lauryl sulfonate, magnesium lauryl sulfonate, etc.

The concentration of metal sulfonate which may be employed may vary over a wide range depending upon the concentration of the potassium borate particles. Generally, however, the concentration may range from 0.2 to about 5 weight percent and preferably from 0.3 to 3 weight percent.

In the most preferred embodiment of this invention, from 0.01 to 2 weight percent and preferably from 0.1 to 2 weight percent of a succinimide dispersant is also present in the borate-containing lubricating compositions. These succinimides are usually derived from the reaction of alkenyl succinic acid or anhydride and alkylene polyamines. These compounds are generally considered to have the formula:

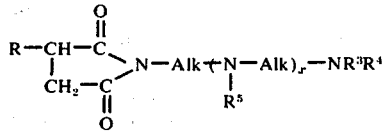

wherein R is a substantially hydrocarbon radical having a molecular weight from about 400 to 3000 (that is, R is a hydrocarbon radical containing about 30 to about 200 carbon atoms), Alk is an alkylene radical of 2 to 10, preferably 2 to 6, carbon atoms, $R^3$, $R^4$ and $R^5$ are selected from a $C_1$ to $C_4$ alkyl or alkoxy or hydrogen (preferably hydrogen) and x is an integer from 0 to 6, preferably 0 to 3. (The actual reaction product of alkenyl succinic acid or anhydride and alkylene polyamine will comprise a mixture of compounds, including succinamic acids and succinimides. However, it is customary to designate this reaction product as "succinimide" of the described formula, since that will be a principal component of the mixture. See U.S. Pat. Nos. 3,202,678; 3,024,237; and 3,172,892).

These N-substituted alkenyl succinimides can be prepared by reacting maleic anhydride with an olefinic hydrocarbon, followed by reacting the resulting alkenyl succinic anhydride with the alkylene polyamine. The R radical of the above formula, that is, the alkenyl radical, is preferably derived from an olefin containing from 2 to 5 carbon atoms. Thus, the alkenyl radical is obtained by polymerizing an olefin containing from 2 to 5 carbon atoms to form a hydrocarbon having a molecular weight ranging from about 400 to 3000. Such olefins are exemplified by ethylene, propylene, 1-butene, 2-butene, isobutene, and mixtures thereof.

The preferred polyalkylene amines used to prepare the succinimides are of the formula

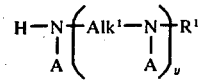

wherein y is an integer from 1 to 10, preferably 1 to 6, A and $R^1$ are a substantially hydrocarbon or hydrogen radical, and the alkylene radical $Alk^1$ is preferably a lower alkylene radical having less than about 8 carbon atoms. The alkylene amines include principally methylene amines, ethylene amines, butylene amines, propylene amines, pentylene amines, hexylene amines, heptylene amines, octylene amines, other polymethylene amines, and also the cyclic and the higher homologs of such amines as piperazines and amino-alkyl-substituted piperazines. They are exemplified specifically by: ethylene diamine, triethylene tetramine, propylene diamines, decamethylene diamine, octamethylene diamine, di(heptamethylene) triamine, tripropylene tetramine, tetraethylene pentamine, trimethylene diamine, pentaethylene hexamine, di(trimethylene) triamine, 2-heptyl 3-(2-aminopropyl) imidazoline, 4-methyl imidazoline, N,N-dimethyl-1,3-propane diamine, 1,3-bis-(2-aminoethyl) imidazoline, 1-(2-aminopropyl)piperazine 1,4-bis (2-aminoethylpiperazine, and 2-methyl-1-(2-aminobutyl)piperazine. Higher homologs such as are obtained by condensing two or more of the above-illustrated alkylene amines likewise are useful.

The ethylene amines are especially useful. They are described in some detail under the heading "Ethylene Amines" in "Encyclopedia of Chemical Technology," Kirk-Othmer, Vol. 5, pp 898–905 (Interscience Publishers, New York, 1950).

The term "ethylene amine" is used in a generic sense to denote a class of polyamines conforming for the most part to the structure

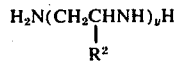

in which $R^2$ is a lower alkyl radical of 1 to 4 carbon atoms or hydrogen, and y is as defined above. Thus, it includes, for example, ethylene diamine, diethylene triamine, triethylene tetramine, tetraethylene pentamine, pentaethylene hexamine, 1,2-diaminopropane, N,N-di(1-methyl-2-aminomethyl)amine, etc.

The mixture of metal sulfonate dispersant and succinimide surface-active dispersant will generally be present in an amount from about 0.25 to 5 weight percent, more usually from about 0.5 to 3 weight percent, of the composition. The actual amount of dispersant mixture will vary with the particular mixture used and the total amount of borate in the oil. Generally about 0.05 to 0.5, more usually about 0.1 to 0.3, parts by weight of mixture will be used per part by weight of the potassium borate. (In the concentrates the mixture concentration will be based on the relationship to potassium borate rather than on the fixed percentage limits of the lubricant, noted above). Generally the upper ranges of the mixture concentration will be used with the upper ranges of the potassium borate concentration.

ADDITIVES

Other materials may also be present as additives in the composition of this invention. Such materials may be added for enchancing some of the properties which are imparted to the lubricating medium by the potassium borate or providing other desirable properties to the lubricating medium. These include additives such as rust inhibitors, antioxidants, oiliness agents, foam inhibitors, viscosity index improvers, pour point depressants, etc. Usually these will be in the range from about 0.01 to 5 weight percent, preferably in the range from about 0.1 to 2 weight percent, of the total composition. An antifoaming agent may also be added with advantage. The amount required will generally be about 0.5 to 50 ppm, based on the total composition.

EXAMPLES

EXAMPLE 1

A glass flask is charged with 102 g of a 126 neutral petroleum oil, 36 g of a neutral calcium petrolum sulfonate (prepared by sulfonating a 480 neutral oil and neutralizing a sulfonic acid with sodium hydroxide followed by metathesis with calcium chloride to form the calcium sulfonate), containing about 1.7% calcium and 12 g of polyisobutenylsuccinimide dispersant (prepared by reacting polysiobutenyl succinic anhydride with tetraethylene pentamine). The contents of the flask are mixed and thereafter a mixture of 100 ml of water containing 120 g of potassium borate (formed by reacting 66 g of 86% pure potassium hydroxide with 124 g of boric acid) is charged to the flask. The contents are vigorously agitated to form a stable microemulsion of the aqueous phase within the oil medium. The emulsion is dehydrated at a temperature of 275° F to yield 278 g of product. This corresponds to approximately 2.5 waters of hydration left in the potassium borate particles. The particulate borate composition is calculated to have the empirical formula:

$$K_2O.2B_2O_3.\ .2.5H_2O$$

EXAMPLE 2

This example illustrates the preparation of a potassium triborate dispersion. A glass flask is charged with 102 g of 126 neutral petroleum oil, 36 g of a neutral calcium sulfonate dispersant of the type disclosed in Example 1 and 12 g of a succinimide dispersant of the type disclosed in Example 1. The contents of the flask are mixed, and thereafter a mixture of 200 ml of water containing 119 g of 86% pure potassium borate (formed by reacting 52 g of potassium hydroxide with 145 g of boric acid) are charged to the flask. The contents are vigorously agitated to form a stable microemulsion of the aqueous phase within the petroleum oil. The emulsion is dehydrated at a temperature of 270° F to yield 286 g of product. Infrared analysis showed 8% water in the emulsion. This corresponds to approximately 3.2 waters of hydration left in the potassium borate particles. The particulate borate composition is calculated to have the empirical formula:

$$K_2O.3B_2O_3.2.2H_2O$$

EXAMPLE 3

The procedure of Example 2 is repeated except that 104 g of a potassium borate (formed by reacting 40 g of 86% pure potassium hydroxide and 152 g of boric acid) are charged to the flask along with 300 ml of water. The flask contents are dehydrated to yield about 274 g of product. The particulate borate composition is calculated to have the approximate empirical formula:

$$K_2O.4B_2O_33.6H_2O$$

EXAMPLE 4

A glass flask is charged with 102 grams of 130 neutral petroleum oil, 36 grams of a neutral calcium petroleum sulfonate of the type disclosed in Example 1 and 12 grams of a polyisobutenyl succinimide of the type described in Example 1. The contents of the flask are mixed and thereafter a mixture of 100 ml of water containing 245 grams of sodium metaborate is charged to the flask. The contents are vigorously agitated to form a stable microemulsion of the aqueous phase within the oil medium. The emulsion is dehydrated at a temperature of about 275° F to yield 300 grams of product. The particulate borate composition is calculated to have the approximate empirical formula:

$$Na_2O.B_2O_3.2H_2O$$

EXAMPLE 5

The procedure of Example 2 is repeated except on a larger scale, and the ratio of dispersants is changed. A kettle is charged with 5628 g of 130 neutral petroleum oil, 974 g of a neutral calcium petroleum sulfonate of the type disclosed in Example 1, and 1817 g of a polyisobutenyl succinimide of the type described in Example 1. The contents of the flask are mixed and thereafter a mixture of 12,500 ml of water containing 2870 g potassium hydroxide and 8000 g boric acid is charged to the flask. The contents are vigorously agitated by a Manton-Gaulin Mill to form a stable microemulsion of the aqueous phase within the oil medium. The emulsion is dehydrated at a temperature up to 265° F. to yield 11,120 g of product. Infrared analysis shows 5% water in the emulsion. This corresponds to approximately 2.0 waters of hydration left in the potassium borate particles. The particulate borate is calculated to have the empirical formula:

$$K_2O.3B_2O_3.2H_2O$$

EXAMPLE 6

10% of the dispersion prepared by the method of Example 5 is blended in SAE 90 hydrocarbon oil to which is added 1.5% water. The mixture is agitated until all of the water is taken up by the borate particles.

Infrared analysis shows 1.6% water in the finished oil. This corresponds to 7.0 waters of hydration in the potassium borate particles. The particulate dispersion is calculated to have the empirical formula:

$K_2O.3B_2O_3.7H_2O$

EXAMPLE 7

The procedure of Example 2 is repeated except that 18 g of the neutral calcium sulfonate described in Example 1 and 30 g of the succinimide described in Example 1 are used.

EXAMPLE 8

The procedure of Example 7 is repeated except that 108 g of neutral oil and 12 g of the calcium sulfonate are used.

EXAMPLE 9

This example is presented to illustrate the various performance properties of the borate-containing compositions. A series of tests are performed with each sample composition to measure the extreme-pressure properties (Timken E.P. Test), the anti-wear properties (4-Ball Wear Test), the compatibility properties (Compatability Test) and the seal leakage properties (Seal Leakage Test). The Timken Test is described in ASTM D-2782-69T, which test procedure is herein incorporated by reference. The 4-Ball Wear Test is described in ASTM D-2873-69T, which test procedure is also herein incorporated by reference. The Compatability Test is conducted by admixing with each weight part of a lube oil containing 5% of a metal borate, one weight part of a lube oil containing 3 to 5 weight percent of a conventional sulfurized ester additive (OLOA 910). The admixture is placed in an oven at 149° C for 24 hours. After this period, if a stable gel of 5% to 100% of the mixture has formed, the compatability is rated as "Fail". If a light gel or sediment representing less than 5% of the mixture or no deposits have formed, the compatability is rated as "Pass". The seal leakage test is conducted by charging a sample of the test oil to a seal leakage apparatus and measuring the amount of oil leakage over a 48 hour period. The seal leakage apparatus is comprised of a sealed chamber with a shaft passing through and journalled to the chamber. Seals are provided at each end of the chamber encompassing the shaft so as to prevent oil from within the chamber from leaking along the shaft to outside collection cylinders. The shaft is turned at 3600 rpm and the oil within the chamber is maintained at atmospheric pressure and at a temperature of about 57° C. A test oil which has less than 10 ml of oil leakage over a 48-hour period with no deposit on the shaft is noted as "Good". A test oil having a leakage of 10 to 30 ml of oil over a 48-hour period with light deposit is rated as "Moderate". A test oil which has more than 40 ml of oil leakage and a heavy deposit over 48 hours is noted as "Poor".

A group of 7 oil samples is tested. The oil samples correspond to the borate-containing lubricant disclosed in the preceding 6 examples with the exception of the last one. Test sample 18 is prepared by the method of Example 4, except dehydrated to a lower water content. Thus, test sample 1 is the lubricant of Example 1, test sample 2 is the lubricant of Example 2, etc. Each of the oil samples is subjected to the above 4 tests (Timken, 4-Ball Wear, Compatability and Seal Leakage), and the data from these tests are reported in the following Table I.

TABLE I

PROPERTIES OF BORATE DISPERSIONS

| Test Sample | Concentration, wt.% | Borate | Timken Load (Pass, lbs.) | 4-Ball Wear, mm | Seal Leakage | Compatability |
|---|---|---|---|---|---|---|
| 1 | 10% | $K_2O . 2B_2O_3 . 2.5H_2O$ | 100 | 0.439 | — | Fail |
| 2 | " | $K_2O . 3B_2O_3 . 2.8H_2O$ | 100 | 0.54 | Good | Pass |
| 3 | " | $K_2O . 4B_2O_3 . 3.6H_2O$ | 60 | 0.60 | — | Pass |
| 4 | " | $Na_2O . B_2O_3 . 2.0H_2O$ | 100 | 0.39 | Poor | Fail |
| 5 | " | $K_2O . 3B_2O_3 . 2.0H_2O$ | 40 | — | — | — |
| 6 | " | $K_2O . 3B_2O_3 . 7.0H_2O$ | 100 | — | Poor | Pass |
| 18 | " | $Na_2O . B_2O_3 . 1.0H_2O$ | 100 | 0.40 | Good | Fail |

The water-tolerance properties of the sample oils are determined by either of two comparable tests. In the first test, water is added to an oil containing 5 weight percent borate solids until the water content is 10%. The mixture is then heated up to 110° C. until only 2% water remains in the oil. The partially dehydrated solution is checked daily for quantity and hardness of any deposits. Those samples having several hard deposits are rated poor, while those having few or no deposits are rated good. In the second test, a modification of Coordinating Research Counsel L-33 Test is used. In this test, 2.5 pints of test lubricant are placed in a bench-mounted automotive differential assembly and water added. The differential assembly is then turned while heating and subsequently subjected to additional heating without turning. In the modification of the test used herein, water in an amount of about 250 cc (rather than 28.3 cc) is added and the differential assembly is turned continuously during heating. The same rating of poor and good is employed in this test. Since both of the tests produce comparable results for the purposes of this invention, there is no designation in the table below of the particular test used to derive the data for each one.

The antiwear characteristics of the composition of the second embodiment of this invention are determined by using the composition as the test lubricant in the well-known "Four-Ball" test. This test is described in Boner, pages 222–224. In the test three ½ inch steel balls of the type commonly used in ball bearings are placed in a steel cup and clamped in fixed position. A fourth ball of the same type is held rigidly on the end of a shaft which rotates about a vertical axis. The balls are immersed in the test lubricant and the fourth ball is forced against the other three under a measured load. The fourth ball is then rotated at a designated speed for a fixed period. At the end of this period, the wear scar diameters on the three fixed balls are measured and averaged, and the average scar size reported as the result of the test. The smaller the wear scar, the better the EP characteristics of the test lubricant. In order to be considered a satisfactory EP lubricant, the lubricant

TABLE III

| Test No. | Borate Additive Type | Conc. (wt.%) | Dihydrocarbyl Dithiophosphate Type | Conc. (wt.%) | Scar Dia. (mm) | Water Tolerance |
|---|---|---|---|---|---|---|
| | PROPERTIES OF BORATE AND ANTIWEAR AGENT COMBINATION | | | | | |
| 1 | none | — | none | — | 0.71 | Good |
| 2 | $K_2O \cdot 3B_2O_3 \cdot 3.2H_2O$ (Ex. 7) | 10 | none | — | 0.61 | Good |
| 3 | none | — | Zn di(4-methyl-2-pentyl) dithiophosphate | 0.5 | 0.62 | — |
| 4 | none | — | Zn di(2-ethyl-1-hexyl) dithiophosphate | 0.5 | 0.62 | — |
| 5 | none | — | Zn di(2-ethyl-1-hexyl) dithiophosphate | 0.25 | 0.66 | — |
| 6 | $K_2O \cdot 3B_2O_3 \cdot 3.2H_2O$ (Ex. 7) | 10 | Zn di(4-methyl-2-pentyl) dithiophosphate | 0.1 | 0.51 | — |
| 7 | $K_2O \cdot 3B_2O_3 \cdot 3.2H_2O$ (Ex. 7) | 10 | Zn di(2-ethyl-1-hexyl) dithiophosphate | 0.25 | 0.41 | Good |
| 8 | $K_2O \cdot 3B_2O_3 \cdot 3.2H_2O$ (Ex. 7) | 10 | Zn di(4-methyl-2-pentyl) dithiophosphate | 0.25 | 0.46 (0.43) | Good |
| 9 | $K_2O \cdot 3B_2O_3 \cdot 3.2H_2O$ (Ex. 7) | 10 | Zn di(4-methyl-2-pentyl) dithiophosphate | 0.5 | 0.40 | Good |
| 10 | $K_2O \cdot 3B_2O_3 \cdot 3.2H_2O$ (Ex. 7) | 10 | Zn di(4-methyl-2-pentyl) dithiophosphate | 1.0 | 0.46 | Good |
| 11 | $K_2O \cdot 3B_2O_3 \cdot 3.2H_2O$ (Ex. 7) | 10 | Zn di(isooctyl) dithiophosphate | 0.25 | — | Poor |
| 12 | $K_2O \cdot 3B_2O_3 \cdot 3.2H_2O$ (Ex. 8) | 10 | Zn di(4-methyl-2-pentyl) dithiophosphate | 0.25 | 0.50 | Good |
| 13 | $K_2O \cdot 3B_2O_3 \cdot 3.2H_2O$ (Ex. 8) | 10 | Zn di(isooctyl) dithiophosphate | 0.25 | 0.46 | Poor |
| 14 | $K_2O \cdot 3B_2O_3 \cdot 3.2H_2O$ (Ex. 7) | 10 | Styrene ester of di(2-ethyl-1-hexyl) dithiophosphate | 2.0 | 0.41 | Good |
| 15 | $K_2O \cdot 3B_2O_3 \cdot 3.2H_2O$ (Ex. 7) | 10 | Styrene ester of di(isooctyl) dithiophosphate | 2.0 | 0.41 | Good |
| 16 | $K_2O \cdot 3B_2O_3 \cdot 3.2H_2O$ (Ex. 7) | 10 | Styrene ester of mixture of isobutyl and 2-methyl-1-pentyl dithiophosphate | 2.0 | 0.41 | Good |
| 17 | $K_2O \cdot 3B_2O_3 \cdot 3.2H_2O$ (Ex. 7) | 10 | Styrene ester of di(tetrapropenylphenyl) dithiophosphate | 2.0 | 0.63 | Good |
| 18 | $K_2O \cdot 3B_2O_3 \cdot 3.2H_2O$ (Ex. 7) | 10 | Product of DETA* + 2 mols di(tetrapropenylphenyl) dithiophosphoric acid | 1.0 | 0.43 | Good |
| 19 | $K_2O \cdot 3B_2O_3 \cdot 3.2H_2O$ (Ex. 7) | 10 | Zn di(octadecyl) dithiophosphate | 1.0 | 0.41 | Good |

*Diethylene triamine must not have a Four-Ball scar of greater than 0.6 mm, and preferably not greater than 0.5 mm.

A group of 8 oil samples is tested. The oil samples correspond to the borate-containing lubricant disclosed in the preceding 8 examples. Thus, test sample 1 is the lubricant of Example 1, test sample 2 is the lubricant of Example 2, etc. Each of the oil samples is subjected to the above tests and the data from these tests are reported in Table II.

TABLE II

| Test Sample | Concentration, wt.% | Borate | Timken Load (Pass, lbs.) | 4-Ball Wear,* mm | Seal Leakage | Compatability | Water Tolerance |
|---|---|---|---|---|---|---|---|
| | | PROPERTIES OF BORATE DISPERSIONS | | | | | |
| 1 | 10 | $K_2O \cdot 2B_2O_3 \cdot 2.5H_2O$ | 100 | 0.439 | — | Fail | — |
| 2 | 10 | $K_2O \cdot 3B_2O_3 \cdot 3.2H_2O$ | 100 | 0.54 | Good | Pass | Poor |
| 7 | 10 | $K_2O \cdot 3B_2O_3 \cdot 3.2H_2O$ | 100 | 0.61 | Good | Pass | Good |
| 8 | 10 | $K_2O \cdot 3B_2O_3 \cdot 3.2H_2O$ | 100 | 0.71 | Good | Pass | Good |
| 3 | 10 | $K_2O \cdot 4B_2O_3 \cdot 3.6H_2O$ | 60 | 0.60 | — | Pass | — |
| 4 | 10 | $Na_2O \cdot B_2O_3 \cdot 2.0H_2O$ | 100 | 0.39 | Poor | Fail | Good |
| 5 | 10 | $K_2O \cdot 3B_2O_3 \cdot 2.0H_2O$ | 40 | — | — | — | Good |
| 6 | 10 | $K_2O \cdot 3B_2O_3 \cdot 7.0H_2O$ | 100 | — | Poor | Pass | Good |

*50-kg applied weight, 30-minute operating time and 1730 rpm

EXAMPLE 10

This example is presented to illustrate the synergism between the zinc dihydrocarbyl dithiophosphate additive and the particulate borate in improving the antiwear properties of the lubricant. In this example, several sample lubricants are subjected to the ASTM Four-Ball Wear Test (ASTM D-2873-69T) and to the Water Tolerance Test described supra. The test lubricants are composed of 126 neutral petroleum oil containing a calcium sulfonate dispersant of the type disclosed in Example 1 and a succinimide dispersant of the type also disclosed in Example 1, and containing 10 weight percent of a potassium burate prepared by the method of Example 7. Varying amounts of dihydrocarbyl dithiophosphate zinc salts and esters are added to the test sample and the samples are then subjected to the ASTM Four-Ball Wear Test: 50-kg applied weight, 30-minute operating time and 1730 rpm. The results of these tests are displayed in Table III. The Four-Ball scar diameter is unexpectedly lower for mixtures of the potassium borate and zinc dithiophosphates than for either compound alone.

What is claimed is:

1. A lubricating oil containing dispersed therein from 2.5 to 25 weight percent, based on the weight of the composition, of a particulate hydrated potassium borate having a mean particle size less than 1 micron and having a boron-to-potassium ratio of 2.5 to 3.5.

2. The lubricating oil defined in claim 1 wherein an oil-soluble alkali or alkaline earth metal sulfonate dispersant is also present.

3. The lubricating oil defined in claim 2 wherein an oil-soluble succinimide dispersant is also present.

4. The lubricating oil defined in claim 2 wherein said particulate potassium borate has from 2.0 to 4.8 waters of hydration.

5. A lubricating oil composition containing dispersed therein from 1 to 60 weight percent of a hydrated potassium borate having the empirical formula:

$$K_2O.3B_2O_3.xH_2O$$

wherein x is a number from about 2 to about 4.8, said potassium borate being dispersed with a combination of an oil-soluble alkali or alkaline earth metal sulfonate dispersant and an alkenyl succinimide dispersant.

6. The composition defined in claim 5 wherein said alkali or alkaline earth metal sulfonate dispersant is a calcium petroleum sulfonate.

7. The composition defined in claim 6 wherein said alkenyl succinimide dispersant has the general formula:

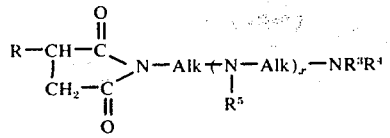

wherein R is a substantially hydrocarbon radical having a molecular weight from 400 to 3000; $R^3$, $R^4$ and $R^5$ are selected from a $C_1$ to $C_4$ alkoxy, or hydrogen; Alk is a $C_2$ to $C_{10}$ alkylene, and x is an integer from 0 to 6.

8. The composition defined in claim 7 wherein from 0.2 to 5 weight percent of said calcium petroleum sulfonate and from 0.01 to 2 weight percent of said alkenyl succinimide are present.

9. In a method for lubricating a device wherein two metallic moving parts are separated by a lubricant, the improvement comprising using as the lubricant a lubricating oil containing dispersed therein from 2.5 to 20 weight percent of microparticles of hydrated potassium borate having a boron-to-potassium ratio of 2.5 to 4.5.

10. A method for preparing a lubricant having improved extreme-pressure properties which comprises admixing with an oil of lubricating viscosity a particulate hydrated potassium borate having a mean particle size of less than 1 micron and having a boron-to-potassium ratio of 2.5 to 4.5.

11. A lubricating oil containing: (1) an oil of lubricating viscosity; (2) from 1 to 60 weight percent of particulate hydrated potassium borate having a mean particle size of less than 1 micron and having a boron to potassium ratio of 2.5 to 4.5 dispersed in said oil; and (3) from 0.1 to 5 weight percent of an antiwear agent selected from: (a) a zinc dihydrocarbyl dithiophosphate having from 4 to 20 carbons in each hydrocarbyl group; (b) a $C_1$ to $C_{20}$ ester, $C_1$ to $C_{20}$ amide, or $C_1$ to $C_{20}$ amine salt of a dihydrocarbyl dithiophosphoric acid having from 4 to 20 carbons in each hydrocarbyl group; or (c) mixtures thereof.

12. A lubricating oil of claim 11 containing dispersed therein from 2.5 to 25 weight percent, based on the weight of the composition, of a particulate hydrated potassium borate having a mean particle size less than 1 micron and having a boron-to-potassium ratio of 2.5 to 4.5, and containing from 2 to 5 waters of hydration, and from 0.1 to 2 weight percent of an antiwear agent selected from: (a) a zinc dihydrocarbyl dithiophosphate having from 4 to 20 carbons in each hydrocarbyl group; (b) a $C_1$ to $C_{20}$ ester, $C_1$ to $C_{20}$ amide, or $C_1$ to $C_{20}$ amine salt of a dihydrocarbyl dithiophosphoric acid having from 4 to 20 carbons in each hydrocarbyl group; or (c) mixtures thereof.

13. The lubricating oil defined in claim 12 wherein said antiwear agent is a zinc dihydrocarbyl dithiophosphate having from 5 to 12 carbons in each hydrocarbyl group.

14. The lubricating oil defined in claim 13 hydrocarbyl is an alkyl having $C_1$ to $C_3$ sterically hindered branches.

15. The lubricating oil defined in claim 12 wherein oil-soluble alkali or alkaline earth metal sulfonate dispersant is also employed.

16. The lubricating oil defined in claim 15 wherein an oil-soluble succinimide dispersant is also present.

17. The lubricating oil defined in claim 16 wherein said particulate potassium borate has from 2.8 to 4.8 waters of hydration.

18. A lubricating oil composition containing dispersed therein: (1) 2.5 to 25 weight percent of a hydrated potassium borate having the empirical formula $$K_2O.yB_2O_3.xH_2O$$

wherein $x$ is a number from 2 to about 4.8 and y is a number from about 2.5 to about 4.5, said potassium borate being dispersed in a combination of an oil-soluble alkali or alkaline earth metal sulfonate dispersant and an alkenyl succinimide dispersant; and (2) from 0.1 to 5 weight percent of an antiwear agent selected from: (a) a zinc dihydrocarbyl dithiophosphate having from 4 to 20 carbons in each hydrocarbyl group; (b) a $C_1$ to $C_{20}$ ester, a $C_1$ to $C_{20}$ amide, or $C_1$ to $C_{20}$ amine salt of a dihydrocarbyl dithiophosphoric acid having from 4 to 20 carbons in each hydrocarbyl group; or (c) mixtures thereof.

19. The composition defined in claim 18 wherein said alkali or alkaline earth metal sulfonate dispersant is a calcium petroleum sulfonate.

20. The composition defined in claim 19 wherein said alkenyl succinimide dispersant is a polyisobutenyl succinimide prepared by reacting polyisobutenyl succinic anhydride with tetraethylene pentamine.

21. The composition defined in claim 19 wherein said antiwear agent is a zinc dihydrocarbyl dithiophosphate.

22. The composition defined in claim 21 wherein said zinc dihydrocarbyl dithiophosphate is a zinc dialkyl dithiophosphate wherein the alkyl groups are sterically hindered.

23. A method for preparing a lubricant having improved extreme-pressure properties which comprises admixing with an oil of lubricating viscosity: (1) particulate hydrated potassium borate having a mean particle size of less than 1 micron and having a boron-to-potassium ratio of 2.5 to 4.5, and (2) an antiwear agent selected from (a) a zinc dihydrocarbyl dithiophosphate having from 4 to 20 carbons in each hydrocarbyl group; (b) a $C_1$ to $C_{20}$ ester, $C_1$ to $C_{20}$ amide, or $C_1$ to $C_{20}$ amine salt of a dihydrocarbyl dithiophosphoric acid having from 4 to 20 carbons in each hydrocarbyl group; or (c) mixtures thereof.

24. In a method for lubricating a device wherein two metallic moving parts are separated by a lubricant, the improvement comprising using as the lubricant the composition of claim 12.

* * * * *

UNITED STATES PATENT AND TRADEMARK OFFICE

CERTIFICATE OF CORRECTION

PATENT NO. : 3,997,454

DATED : December 14, 1976

INVENTOR(S) : John Howard Adams

It is certified that error appears in the above-identified patent and that said Letters Patent are hereby corrected as shown below:

Column 1, line 50, "it sealed" should read --in sealed--

Column 5, line 59, "have SAE" should read --having SAE--

Column 9, line 17, "enchancing" should read --enhancing--

Column 10, line 10, "$K_2O.3B_2O_3.2.2H_2O$" should read --$K_2O.3B_2O_3.3.2H_2O$--

Column 10, line 20, "$K_2O.4B_2O_3$ $3.6H_2O$" should read --$K_2O.4B_2O_3.3.6H_2O$--

Column 15, line 11, "a $C_1$ to $C_4$ alkoxy" should read --a $C_1$ to $C_4$ alkyl, a $C_1$ to $C_4$ alkoxy--

Column 15, line 34, "0.1 to 5" should read --0.01 to 5--.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*